US005386665A

United States Patent [19]

Heim

[11] Patent Number: 5,386,665

[45] Date of Patent: Feb. 7, 1995

[54] AUTOMATED/REMOTE CONTROL APPARATUS AND METHOD FOR GRINDING RUBBER BELTS USED TO COMPACT PAPER AND OTHER WEB MATERIAL

[75] Inventor: Albert Heim, Oberagi, Switzerland

[73] Assignee: Clupak, Inc., New York, N.Y.

[21] Appl. No.: 951,107

[22] Filed: Sep. 28, 1992

[51] Int. Cl.[6] ..... B24B 49/00

[52] U.S. Cl. ..... 451/5; 451/8; 451/304; 451/456

[58] Field of Search ..... 51/165.71, 165.74, 165.76, 51/135 R, 142, 241 S, 251, 252, 273, 289 R, 328

[56] References Cited

U.S. PATENT DOCUMENTS

| | | | |
|---|---|---|---|
| 4,640,056 | 2/1987 | Stump | 51/140 |
| 4,930,262 | 6/1990 | Sennewald | 51/165.76 |
| 4,941,294 | 7/1990 | Nakagaki | 51/328 |
| 5,097,636 | 3/1992 | Crouch et al. | 51/273 |
| 5,185,961 | 2/1993 | Maier | 51/165.77 |
| 5,193,314 | 3/1993 | Wormley et al. | 51/165.71 |

*Primary Examiner*—Maurina T. Rachuba
*Attorney, Agent, or Firm*—James F. Bryan

[57] ABSTRACT

The present invention is applicable to grinding apparatus for removing irregularities from and for levelling the working surface of thick, large width rubber belts used to compact paper or (in the case of fabric, preshrink) fibrous webs; and the control of such grinding apparatus. The present invention permits grinding during production use of a belt when the environment near (above) the belt is inimical to visual grinding control by personnel due to high heat and steam. Sensing and control means placed remotely from the working surface of the belt permits an operator to control grinding more precisely than if done visually and without subjecting the operator to dangerously adverse working conditions.

5 Claims, 1 Drawing Sheet

AUTOMATED/REMOTE CONTROL APPARATUS AND METHOD FOR GRINDING RUBBER BELTS USED TO COMPACT PAPER AND OTHER WEB MATERIAL

BACKGROUND OF THE INVENTION

The present invention finds its application in the grinding (resurfacing, to provide a smooth surface) of rubber belts which are used to compact and attenuate paper webs or other web material such as fabric. As known in the art, such compaction can in an appropriate paper web, increase tear, tensile energy absorption and burst strengths, and can effect shrinkage control in a fabric web.

Rubber belts used for this purpose are in the order of 1-2 inches in thickness; may exceed 80 inches in width, and when used in the paper industry have a Shore A durometer of 45-60. Compaction of the web (paper or fabric) occurs when the belt is stretched as it passes around a nip bar immediately prior to entering a compaction zone formed between the belt (carrying the web in frictional engagement therewith) and a steel roller against which the belt and paper slip. The web is foreshortened when the belt contracts in the compaction zone.

The foregoing takes place at production speeds which may, for example, be 1600 to 2500 feet/minute and because steam facilitates web compaction in the compaction zone, compaction takes place at fairly high temperatures. In such environment, constant flexing of the surface of the belt and rubbing of the belt against the steel roller in the compaction zone cause wrinkling and uneven wearing of the belt surface. This adversely affects the compaction process and reduces belt life.

Therefore, provision must be made periodically to resurface the paper contacting (outside) surface of the rubber belt since after a number of operating hours this surface will develop wrinkles which will transfer to the paper surface and the edges not covered by the paper will become hard and glazed, inviting surface cracks in the belt. These surface defects must be removed by grinding to restore a smooth working surface for proper operation of the compacting unit and to prolong the belt life.

A traversing belt type grinder (for example, grinder belt width =4 inches) has proved most satisfactory for machines over 80 inches in width (2032 mm) while a full width roll type grinder may be used, with proper design, on narrower machines. In either case, grinder belt grit of 60 to 120 is preferred for most grinding while a 50 grit may be used for removing a large amount of rubber. It is fairly common for rubber belts used to compact paper to be 200 inches in width. Current grinding practice is to position the grinder belt to initially grind the belt surface during one full rotation of the belt; and then to laterally move the grinder 2 inches (where the grinder is 4 inches wide) so that the grinder will overlay the previously ground surface by 2 inches. Therefore, if the rubber belt whose surface is being ground has a width of 200 inches, one hundred revolutions of the belt will be required to grind the entire surface.

Provision should be made for grinding to take place at the operator's option both during production at full production speed and with the unit operating at crawl drive speed of 80 fpm (24.38 m/min). When grinding is done during extensible paper production at full production speed, belt tension may be set for example at 40 lb/in (70 newtons/centimeter) or tension may depend upon the system. The belt will be hot when grinding during production so the grinder should be set for a very light cut during each traverse to prevent rubber dust from bailing up and becoming sticky. The average depth of cut should be no more than 0.05 mm during each traverse, just enough to cut the belt surface. Two or three traverses is usually all that is necessary to clean and refinish the belt surface with fresh, "live", rubber. During production grinding should be done at least once per production day to maintain a resilient, "live" surface. Currently, when heavier grinding has been required, it has been done at crawl speed which, for a 200 inch belt, takes about 3-4 hours. If this results in lost production time, the economic loss can be considerable since such loss can be 30 tons per hour at $1000 per ton for compacted paper production.

It has been found that present grinding systems do not properly lend themselves to operation during production use of the compacting (extensible) units. Operators are forced to work from traversing platforms which carry the grinding apparatus and which are subject to high heat. This often has necessitated such operators to leave the traversing platforms periodically with unsatisfactory and even disastrous results. Current resurfacing techniques are deficient as well since belt surface areas are normally removed under some form of imprecise visual control. Furthermore, present grinding apparatus has been known to cause hazardous explosive conditions due to improper control of particulates created by the grinding process. It is the purpose of the present invention to address these problems and to provide solutions therefor.

SUMMARY OF THE INVENTION

The present invention is applicable to existing grinding and traversal apparatus but provides significant improvement thereto. In combination with the traversal apparatus which carries the grinder belt, grinder belt drive and grinder belt positioning mechanism, a first sensing means shall be provided to sense the thickest portion of the rubber belt. Remote control of the traversal apparatus, instead of from the traversal platform shall be provided, thus eliminating the need for personnel to remain with and visually control the traversal apparatus. Positioning of the grinder belt visa vis the surface of the belt and rate of traversal shah be remotely controlled from a control panel adjacent to the extensible unit. The within invention completely eliminates the current method which requires one operator to be present upon a platform in close proximity to the surface of the rubber belt while belt grinding is taking place.

Once the thickest part of the belt has been determined both laterally and longitudinally, the grinder belt shall be set at the control panel to remove for example 0.05 mm from the thickest portion of the upper surface thereof. In accordance with prescribed control of traverse and belt speed, the grinder belt shall traverse the entire portion of the belt from which the prescribed amount shall be removed. When this is completed, the grinder belt shall be set toward the surface of the belt another incremental 0.05 mm and this shall be repeated until the entire working surface (i.e. the surface in contact with the web during compaction) as detected by the sensing means is indicated to be smooth and non-variable in thickness. The present invention also permits selective control and grinding of individual "high spots" and fast traverse between these to reduce time required for grinding the entire surface, as shall be explained in greater detail.

Belt sensing and grinding control means are provided to recess the edges of the belt, for example, 2 mm less than the thickness of the belt beneath the working surface. This removes the glaze that develops and any tendency for the belt to develop cracks along its edges.

The above procedure and the control of the grinder belt which precisely limits removal of variations in thickness to the prescribed depth also greatly inhibits overload of the grinder motor.

It may be that under certain conditions, dust generated during the grinding process may find its way between the grinder belt and its drive wheel, and that an accumulation of such dust can mechanically impede driving the grinder belt. In such case the grinding wheel motor will require more electrical power. The present invention includes sensing means to determine whether such required power is within prescribed norms and if exceeded, to cause the grinder belt to discontinue operation and its contact with the surface of the belt. This procedure prevents overload of the grinder which can cause breaking of the grinder belt and injury to the surface of the belt.

In an alternate overload condition wherein the grinder belt excessively contacts the belt, the surface of the belt can become frictionally overheated to the extent that dust being ground from its surface can catch fire. While this condition should not arise if the automated control and depth sensing of this invention is operating properly, nevertheless if the grinder belt should excessively contact the belt, the means provided herein shall automatically discontinue the operation of the grinder motor and contact of the grinder belt with the belt.

Another feature of the inventive apparatus is an electrical interlock between the grinder belt drive motor and dust aspirating means provided to collect and remove dust resulting from the grinding process. Such interlock shall prevent operation of the grinding motor if the aspirating mechanism is not simultaneously operating.

DESCRIPTION OF A PARTICULAR EMBODIMENT

Figure 1:
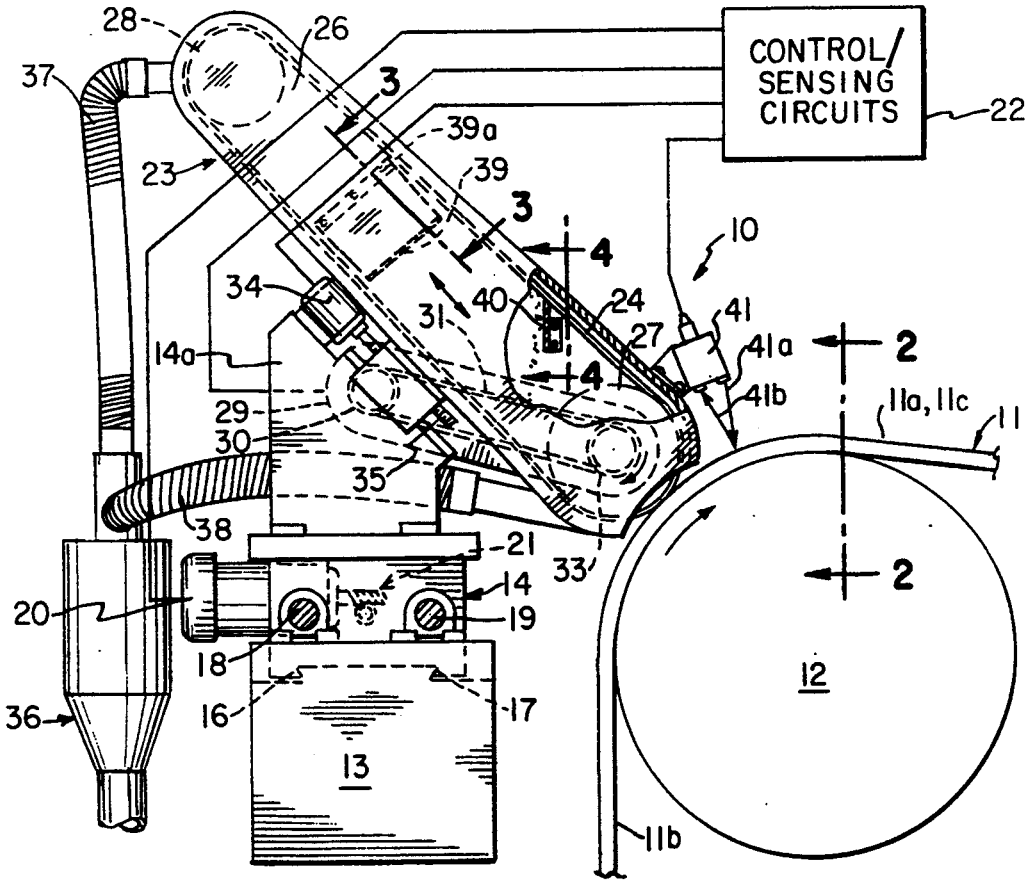
FIG. 1 illustrates a portion of an extensible (paper compacting) unit in combination with a belt grinder, belt grinder carriage, drive motors, etc. and remote control means for sensing and controlling the belt grinder carriage and drive motors in accordance with invention.

Referring now to the drawing and initially to FIG. 1 thereof, there has been illustrated an apparatus 10 which incorporates the features and principles of the present invention. The apparatus 10 includes a rubber belt 11 of the type used to compact a paper web (not shown); but it will be understood that the present invention has general application to compacting apparatus for different kinds of webs which use similar, if not identical, compacting rubber belts.

Figure 2:
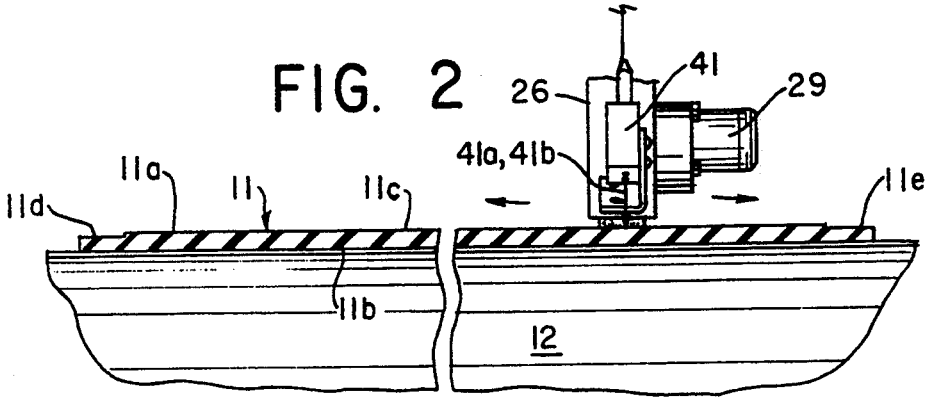
FIG. 2 illustrates in greater detail the construction of a rubber belt, the working surface thereof, and its recessed edge sections.
Figure 3:
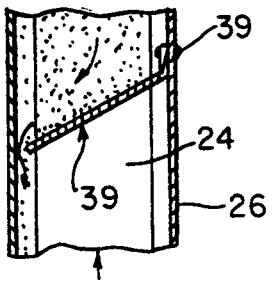
FIG. 3 is a section taken in the direction of arrows 3—3 of FIG. 1.
Figure 4:
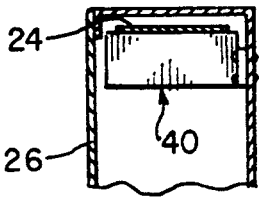
FIG. 4 is a section taken in the direction of arrows 4—4 of FIG. 1.

As illustrated, belt 11 is carried in the direction indicated by the arrow by a large diameter roller 12, the upper surface of belt 11 being designated by reference numeral **11*a* and the lower surface in contact with roller 12 being designated 11*b*. For purposes of description, it will be understood that belt 11 is sufficiently wide to accommodate compaction of a paper web sixty or more inches wide. As shown in FIG. 2, the upper surface 11*a* thereof has a working section generally indicated by reference numeral 11*c* which shall contract a paper web (not shown) for compaction thereof; and edge sections 11*d*, 11*e*** which are recessed and do not contact the paper web.

The apparatus for grinding and smoothing the upper surface of belt 11 includes a stationary supporting beam or base 13 extending transversely (widthwise) adjacent to belt 11 and roller 12. Mounted upon base 13 is a carriage 14 which is transversely slidable upon base 13 on ways 16, 17 and upon cylindrical supports 18, 19. Carriage 14 may be driven by electric motor 20 connected to worm/screw mechanism 21, motor 20 being remotely controlled by control/sensing circuits diagrammatically illustrated in FIG. 1 located within control panel 22

Carriage 14 is secured to belt grinding apparatus which has been generally indicated by reference numeral 23. A grinder belt 24 encased in housing 26 follows a curvilinear path as illustrated about a grinder wheel 27 at its lower extremity and about an idler pulley 28 at its upper extremity. Housing 26 is open at the lower end to permit grinder belt 24 to come into contact with belt 11. Power to drive grinder wheel 27 is supplied by motor 29 which is directly connected to pulley 30 and, through belts 31 and 32 to pulley 33 which is connected to grinder wheel 27 by belts 31, 32. In order to effectuate movement toward and away from belt 11 of the entire grinding apparatus assembly just described, such apparatus is interconnected to the upper part **14*a* of carriage 14 through motor 34 and worm/screw drive 35**.

It will be noted that a vortex generator 36 or other suction device is attached by tubing 37 and 38 respectively to the upper and lower ends of the grinder belt housing 26. Rubber particles (usually fine dust) carried by the grinder belt 24 into housing 26 will be aspirated therefrom through tubing 37 and 38. To facilitate removal of such material from the grinder housing 26, should dust collect upon the reverse side of the grinder belt, and thereby accumulate between wheel 27 and belt 24, a deflector 39 is attached to the interior of housing 26 at **39*a* to direct accumulated dust from within the belt to fall outside of the belt toward tubing 38 for aspiration from housing 26. A scraper or brush 40 has also been provided to remove accumulations of dust which may adhere to the undersurface of the grinder belt. This will avoid build-up of ground particulates between the grinder wheel 27 and grinder belt 24 which could cause motor 29 to overload. An electrical interlock shall prevent operation of the grinder motor 29** if the aspirating mechanism is not operating.

Remote control/sensing circuits located in control panel 22 have been provided in relation to the apparatus thus far described, since it is the overall purpose of the present invention to eliminate the presently practiced system of manual and visual control for grinder belts.

Accordingly, it will be observed that each of the motor drive mechanisms for transverse carriage movement; for movement of the grinder belt and its housing toward and away from the belt; and for driving the grinder belt itself are controlled remotely (as indicated schematically) from a control panel 22 which also either incorporates the sensing means which shall now be described or which is connected to such sensing means.

Attached to housing 26 is a sensor 41, which in the illustrated embodiment is an infra-red laser displacement sensor, particularly adapted to sense and measure variations in height in the working surface of belt 11. Sensor 41 has been mounted at a prescribed (precalibrated) distance from the surface of grinder belt 24 when it is at its nearest proximity to the working surface 11*c* of belt 11 and shall project a beam from 41*a* which is reflected from the working surface which is received at 41*b*. Sensor 41 is linked electronically to control panel 22 which includes means to digitally record and display the various irregularities in height of the working surface 11*c* as the sensor 41 traverses the working surface of belt 11.

Since the contemplated procedure shall be to grind the belt to a predetermined smoothness during actual production, that is while compacting paper web, the transverse thickness and variants thereof will first be sensed by sensor 41 and recorded at the control panel 22 by recording such variants during at least one complete traverse of belt 11 in order to determine the greatest thickness thereof both transversely and in the belt moving (longitudinal) direction. After this has been recorded, and in accordance with a first method to be practiced pursuant to the invention, the control means for motor 34 (movement of grinder belt toward belt 11) motor 29 (drive motor for grinding wheel 27) and carriage motor 20 will be set at the control panel to effect placement of the grinder belt in contact with belt 11 and to regulate transverse movement of carriage 14 to cause removal of say 0.05 mm of the greatest thickness of belt 11. It will be understood that in accordance with detection provided by sensor 41, at least initially, only the highest section of the upper surface of belt 11 may be subject to grinding; however, as successive removal of 0.05 mm increments of the belt surface take place, more and more surface area shall be included until the entire surface shall be subjected to a predetermined cut. If movement of the belt should cease, an electrical interlock will effect discontinuance of contact between the grinder and belt and shut-off of grinder apparatus.

The foregoing procedure may be contrasted with present practice which not only requires the presence of an operator on the carriage during some or all of the grinding operation but also requires the operator visually to determine the placement of the grinder and the amount of grinding (one method is to remove chalking from visually perceived "high" areas). Since the current practice requires such visual control under extreme heat and moisture conditions (when done during production) mistakes and inaccuracies occur; for example overload of the grinder motor; injury to the belt surface and even the possibility of fire or explosion. It will be noted that grinder motor 29 is connected with sensing and control means 22; and should an overload (by increase of amperage above a predetermined level) of motor 30 be sensed, its operation shall be discontinued. Simultaneously control and sensing means 22 shall move the entire belt grinding apparatus away from belt 11 by actuation of motor 34.

In accordance with another method which may be used in accordance with the present invention, before commencing the grinding of belt 11, sensing device 41 shall first be caused rapidly to traverse the entire working surface 11*c* of belt 11 and all patterns of height irregularities thereon shall be identified and recorded. In accordance with this method, after this initial step, the grinding apparatus shall be programmed to begin an initial phase by making a series of adjacent longitudinal cuts to reduce the height of the thickest (highest) sensed section of the belt, until such section has been reduced to the height of the next highest and so on. The traversing mechanism shall be programmed to move the grinder mechanism quickly from one such section to another to save procedural time. Then after the working surface has generally assumed the same height or thickness, the grinding apparatus shall be programmed to traverse the entire surface (removing only 0.05 mm each traverse) until the surface 11*c* is dressed and smooth.

By using sensor 41 and programmed control of the grinding apparatus, the edges 11*d*, 11*e* of belt 11 may also be recessed 2–3 mm with respect to the working surface 11*c* after the working surface has been completely ground by either of the above-described methods. Edges 11*d* and 11*e* often become glazed during production and to avoid splitting or cracking, require separate grinding after the working surface of the belt has been ground smooth.

It will be understood that the foregoing description relates to a particular embodiment which incorporates the principles of the present invention and is therefore merely representative. In order to appreciate fully the scope of the invention, reference should be made to the appended claims.

I claim:

1. Grinding apparatus for incrementally reducing the thickness of a wide, thick rubber belt about a continuous curvilinear path while the working surface of said belt is subjected to heat and steam to produce compacted web, after said working surface has become irregular and the belt has become uneven in thickness, comprising:

a) means for moving said grinding apparatus toward said working surface for effecting selective incremental contact between said apparatus and said working surface during movement of said belt about said continuous curvilinear path and for moving said grinding apparatus away from said surface to discontinue such contact;

b) means for moving said grinding apparatus transversely and incrementally across the working surface of said belt during movement of said belt about said continuous curvilinear path;

c) means carried by said grinding apparatus for sensing the thickness and variations in thickness of said belt; and d) control and sensing means positioned sufficiently remotely from the working surface of said belt to be unaffected by heat and steam emanating therefrom, for controlling and sensing the respective grinder apparatus moving means under paragraphs (a) and (b) hereof, firstly: to position said grinding apparatus in close proximity to said working surface as sensed by the sensing means of paragraph (c) hereof, secondly; to move said grinding apparatus incrementally transversely across the working surface of said belt while the sensing means of paragraph (c) hereof senses variations in thickness of said working surface; and thirdly: to move said grinding apparatus into contact with said working surface in successive incremental overlapping transverse passes to grind said surface smooth and to render said belt thereunder uniform in thickness.

2. The apparatus of claim 1 wherein there are sensing and control means connected to said grinding apparatus to sense an overload of said means operating and grinding function, and means to stop said grinding function in the event of an overload.

3. The apparatus of claim 2 Wherein means are provided to activate the means for moving said grinding apparatus to move said apparatus away from said working surface in the event of overload of said means operating said grinding function.

4. The apparatus of claim 3 wherein said grinding apparatus is surrounded by a housing, means for aspirating grinder dust from said housing when said means for operating the grinder function causes said grinding apparatus to function, and means for discontinuing the grinder function in the event that said aspirating means is not operating.

5. The apparatus of claim 4 wherein said grinding apparatus includes an endless grinder belt, a drive wheel and pulley supporting said grinder belt in a continuous curvilinear path, means for supporting and positioning said grinder belt and said drive wheel within a vertically lower end of said housing immediately above said working surface and alternatively to bring said grinder belt into controlled contact with said surface, said grinder belt following a curvilinear path within said housing about said drive wheel and about said pulley supported and positioned within a vertically upper end of said housing, said aspirating means including means for removing particulate material from grinding the rubber belt at the lower end of said housing and means for collecting said particulate material within the curvilinear path of said grinder belt and for deflecting said material away from said drive wheel toward said aspirating means at the lower end of said housing.

* * * * *